US007794276B2

(12) United States Patent
Shigeta et al.

(10) Patent No.: US 7,794,276 B2
(45) Date of Patent: Sep. 14, 2010

(54) INSULATING STRUCTURE BETWEEN CONDUCTIVE MEMBERS OF ELECTRIC DEVICE

(75) Inventors: Hiroshi Shigeta, Fujiidera (JP); Yasunori Ueda, Hikone (JP); Masanobu Yamasaki, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 6 days.

(21) Appl. No.: 11/822,897

(22) Filed: Jul. 11, 2007

(65) Prior Publication Data

US 2008/0020619 A1 Jan. 24, 2008

(30) Foreign Application Priority Data

Jul. 21, 2006 (JP) ..... 2006-199815

(51) Int. Cl.
*H01R 13/40* (2006.01)

(52) U.S. Cl. ..... 439/588; 439/205; 439/426

(58) Field of Classification Search ..... 30/42, 30/43, 43.1–43.9, 43.91, 43.92; 439/206, 439/426, 587, 588, 589, 205
See application file for complete search history.

(56) References Cited

U.S. PATENT DOCUMENTS

| | | | | |
|---|---|---|---|---|
| 3,241,095 | A * | 3/1966 | Phillips | 439/199 |
| 4,241,967 | A * | 12/1980 | Collins | 439/589 |
| 4,895,529 | A | 1/1990 | Thakrar et al. | |
| 5,135,406 | A * | 8/1992 | Ishikawa | 439/131 |
| 5,593,319 | A * | 1/1997 | Ohno | 439/587 |
| 5,823,811 | A | 10/1998 | Blanchfield et al. | |
| 5,959,249 | A | 9/1999 | Hotta | |
| 6,193,536 | B1 * | 2/2001 | Sanuki | 439/271 |
| 6,334,785 | B2 * | 1/2002 | Miwa | 439/272 |
| 6,428,331 | B1 * | 8/2002 | Yamakawa et al. | 439/76.2 |
| 6,641,417 | B2 * | 11/2003 | Tanaka et al. | 439/205 |
| 6,935,894 | B2 * | 8/2005 | Fung | 439/606 |
| 7,144,275 | B2 * | 12/2006 | Iida | 439/587 |
| 7,201,592 | B2 * | 4/2007 | Hata | 439/206 |
| 7,338,304 | B2 * | 3/2008 | Kameyama et al. | 439/281 |
| 7,341,484 | B2 * | 3/2008 | Yamamoto | 439/587 |
| 2003/0119359 | A1 * | 6/2003 | Fung | 439/606 |
| 2006/0040551 | A1 | 2/2006 | Plecher et al. | |

FOREIGN PATENT DOCUMENTS

| | | |
|---|---|---|
| JP | 57-66786 | 4/1982 |
| JP | 1-115468 | 8/1989 |
| JP | 11-009852 | 1/1999 |
| JP | 2001-009177 | 1/2001 |

* cited by examiner

*Primary Examiner*—James Harvey
(74) *Attorney, Agent, or Firm*—Bacon & Thomas, PLLC

(57) ABSTRACT

An insulating structure is employed between conductive members of an electric device. The electric device has a housing accommodating electric components therein and a cover member covering the housing, the conductive members being disposed through communication holes of the housing and the cover member. The insulating structure includes contact prevention members for preventing water infiltrated into a gap between the housing and the cover member from contacting water collected in the communication holes for the conductive members, wherein the contact prevention members are interposed between the housing and the cover member. Each contact prevention member has a substantially annular shape, surrounding one of the conductive members.

13 Claims, 12 Drawing Sheets

INSULATING STRUCTURE BETWEEN CONDUCTIVE MEMBERS OF ELECTRIC DEVICE

FIELD OF THE INVENTION

The present invention relates to an insulating structure between conductive members of an electric device.

BACKGROUND OF THE INVENTION

Conventionally, when forming charging terminals at a washable device such as a washable electric shaver, a housing of the device needs to be exposed in the vicinity of the terminals (see, for example, Japanese Patent Laid-open Application No. 2001-244013).

The reason for this configuration is as follows. If the vicinity of the terminals is designed to have a dual structure having a panel or the like attached to the housing, there is a likelihood that the terminals are short-circuited due to an infiltration of a conductive material such as water into a gap between the housing and the panel. If a charging operation is made in such state, an electric potential difference would be generated thereat, which results in electrolytic corrosion of the terminals.

To avoid the corrosion, the vicinity of the terminals needs to be configured in a state where the housing is exposed thereat. That is, the washable device is constructed with a single structure member (housing) only.

Meanwhile, adding a decorative panel on the housing is widely employed because a high-quality appearance of the device can be obtained with a low cost as well as a high degree of freedom in design.

However, when the possibility of the corrosion of the terminals is considered, forming the vicinity of the terminals with a dual structure is not preferable, which can become a factor that limits the design of the vicinity of the terminals as well as the location of the terminals.

SUMMARY OF THE INVENTION

It is, therefore, an object of the present invention to provide an insulating structure between conductive members of an electric device, capable of removing a conventional design limitation, while preventing a short circuit between terminals and electrolytic corrosion.

In accordance with the present invention, there is provided an insulating structure between conductive members of an electric device, the electric device having a housing accommodating electric components therein and a cover member covering the housing, the conductive members being disposed through communication holes of the housing and the cover member, the insulating structure including: contact prevention members for preventing water infiltrated into a gap between the housing and the cover member from contacting water collected in the communication holes for the conductive members, wherein the contact prevention members are interposed between the housing and the cover member, and each contact prevention member has a substantially annular shape, surrounding one of the conductive members. Accordingly, a short circuit between the conductive members can be prevented, whereby an electrolytic corrosion of the conductive members can be avoided. Therefore, the problem of the short circuit between the conductive members and the electrolytic corrosion of the conductive members can be solved, thereby avoiding the design limitation of the device surrounding the conductive members.

Each of the contact prevention members may include a first contact prevention part in firm contact with the housing and a second contact prevention member in firm contact with the cover member, and each contact prevention member may be formed as one body with a sealing member sealing a gap between the housing and the conductive member. Therefore, the watertight structure can be achieved in a simplified manner without increasing the number of components Alternatively, each of the contact prevention member may include a first contact prevention part in firm contact with the housing and a second contact prevention part in firm contact with the cover member, and the contact prevention member may be formed as one body with the cover member, separately from a sealing member sealing a gap between the housing and the conductive member. Therefore, a conventional sealing member can be employed without modification The contact prevention member may be a protrusion whose leading end is in firm contact with a sealing member sealing a gap between the housing and the conductive member, the protrusion being formed as one body with the cover member. As a result, there is no need to prepare the contact prevention member as a separate component, and the sealing member and the leading end are more firmly contacted, thereby enhancing sealing performance.

Further, the contact prevention member may be a protrusion whose leading end is in firm contact with the cover member, the protrusion being formed as one body with the housing, and an elastic member is provided at a portion of the cover member in firm contact with each contact prevention member. As a result, there is no need to prepare the contact prevention member as a separate component, and a conventional sealing member can be employed without modification. Further, the elastic member and the leading end are more firmly contacted, thereby enhancing sealing performance.

Preferably, the contact prevention member is an O-ring which is in firm contact with the housing and the cover member. Therefore, an O-ring available on the market can be employed, thereby achieving reliable sealing performance and cost reduction.

Preferably, the contact prevention member formed as one body with the sealing member is formed with the housing by dual injection molding. Accordingly, the contact prevention member can also be molded when molding the housing, thereby increasing the productivity.

Further, it is preferable that the contact prevention member formed as one body with the cover member is formed with the cover member by dual injection molding. Therefore, the contact prevention member can also be molded when molding the cover member, thereby increasing the productivity.

Preferably, water drain grooves for draining the water infiltrated into the gap between the housing and the cover member are provided at an inner surface of the cover member. Accordingly, a factor generating the short circuit between the conductive members can be minimized.

In case the electric device is an electric shaver, the electric shaver is charged via the conductive members when the electric shaver is mounted in a charging device. Therefore, an operation of charging the electric shaver can be done safely.

BRIEF DESCRIPTION OF THE DRAWINGS

The above and other objects and features of the present invention will become apparent from the following description of embodiments given in conjunction with the accompanying drawings, in which:

FIG. 2 sets forth a perspective view of a washing and charging device for accommodating the electric shaver therein;

DETAILED DESCRIPTION OF THE EMBODIMENTS

Hereinafter, embodiments of the present invention will be described in detail with reference to the accompanying drawings.

First Embodiment

The first embodiment of the invention will be described with reference to FIGS. 1 to 6B.

Figure 1A:
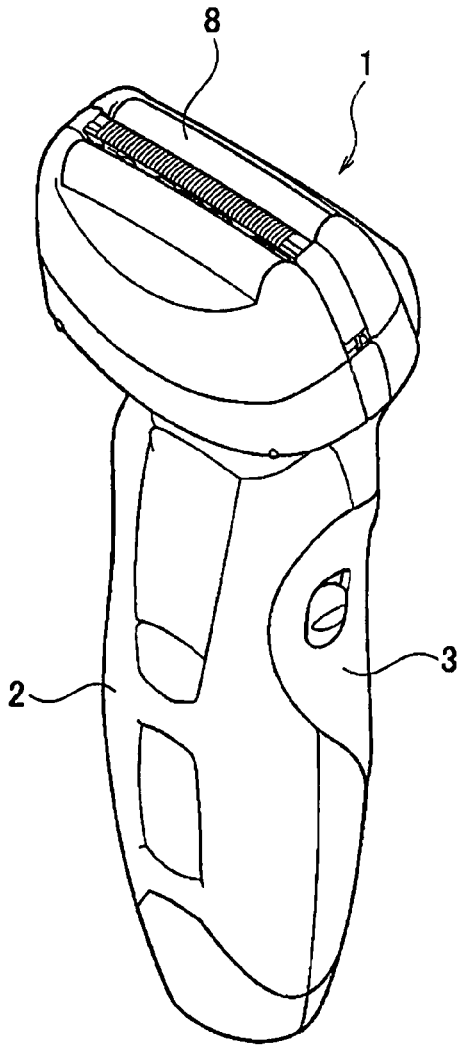
FIG. 1 and FIG. 2 are a perspective view of an electric shaver to which the present invention is applied.
Figure 1B:
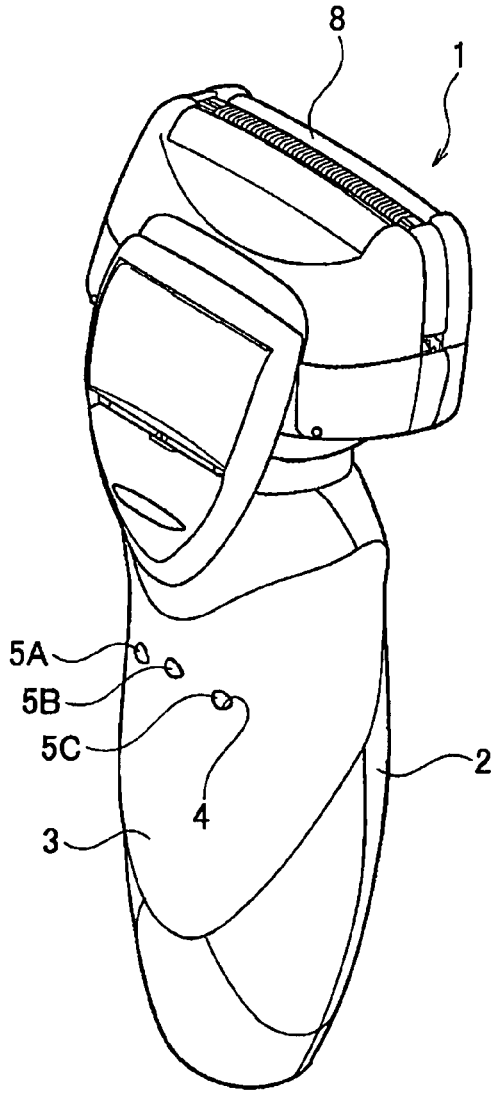

As shown in FIGS. 1A and 1B, electric shaver 1 includes a housing 2 serving as a shaver main body incorporating electric components therein; a cover member 3 serving as a decorative panel covering the housing 2; and a plurality of charging terminal pins made of a conductive member and inserted through communication holes 4 that are formed through the housing 2 and the cover member 3. In this embodiment, the electric shaver 1 exemplary has three charging terminal pins 5A to 5C.

Figure 2:
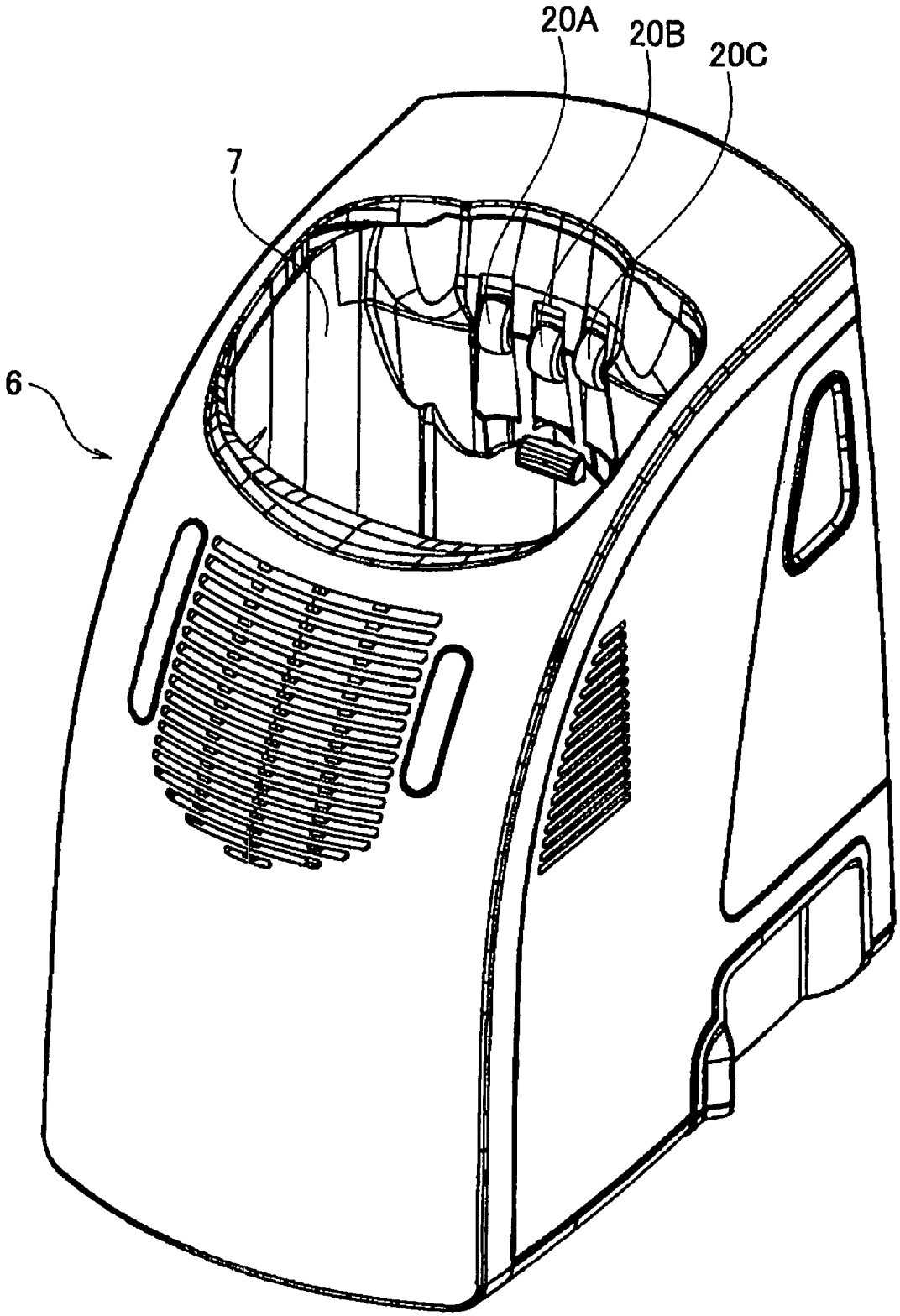
Figure 3:
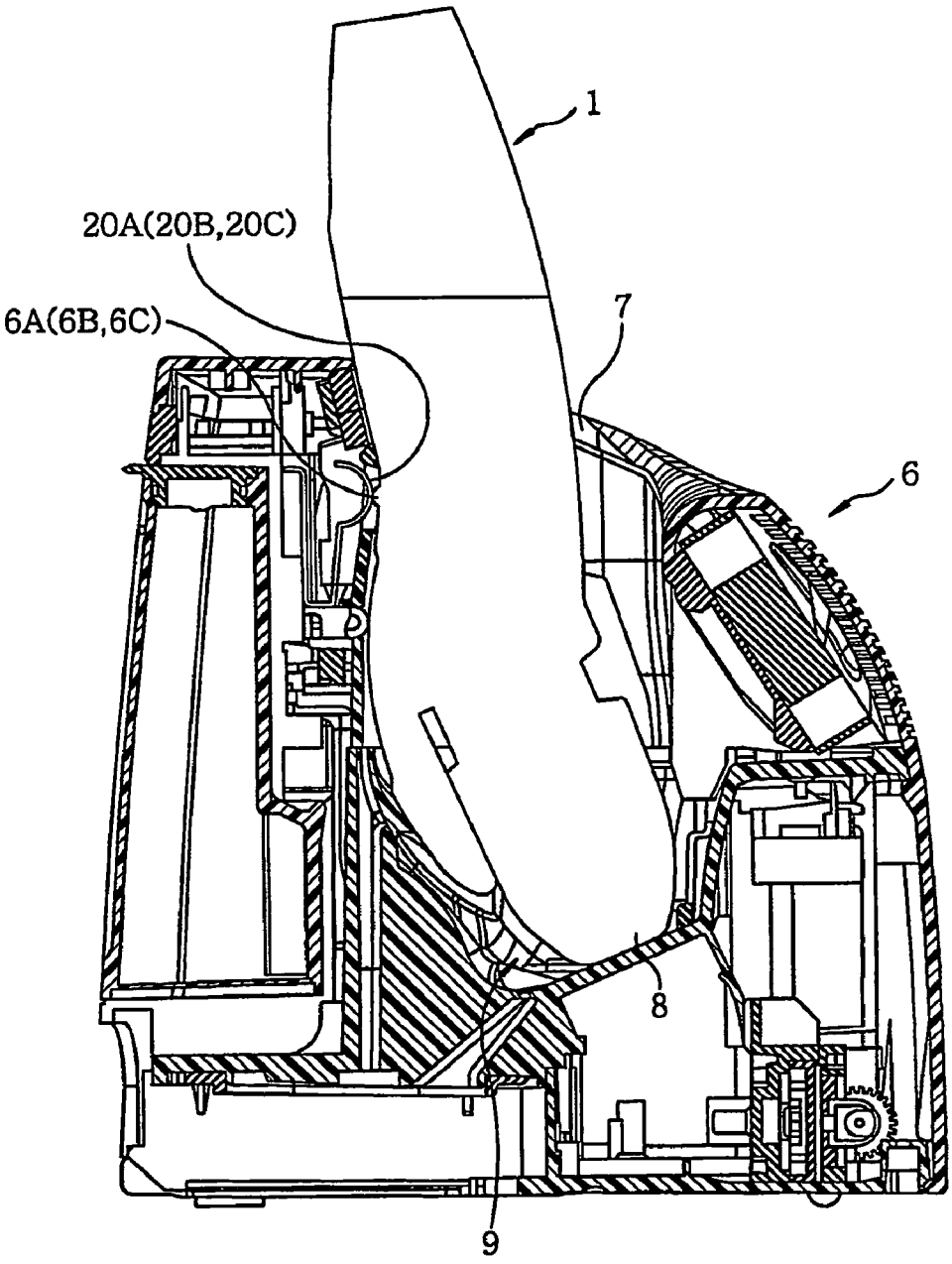
FIG. 3 presents a cross sectional view showing the electric shaver mounted in a washing compartment of the washing and charging device, to be ready for being recharged.

Referring to FIGS. 2 and 3, the electric shaver 1 configured as described above is inserted into the inside of a washing and charging device 6 through an electric shaver loading opening 7 thereof with its cutter block 8 facing downward, and is set in a washing compartment 9 of the washing and charging device 6. The electric shaver 1 set in the washing compartment 9 is charged when its charging terminal pins 5A to 5C respectively contact with contact metal pieces 20A to 20C protruded from the inner wall surface of the washing and charging device 6. The washing and charging device 6 charges the electric shaver 1 while concurrently washing the cutter block 8 of the electric shaver 1.

Figure 4:
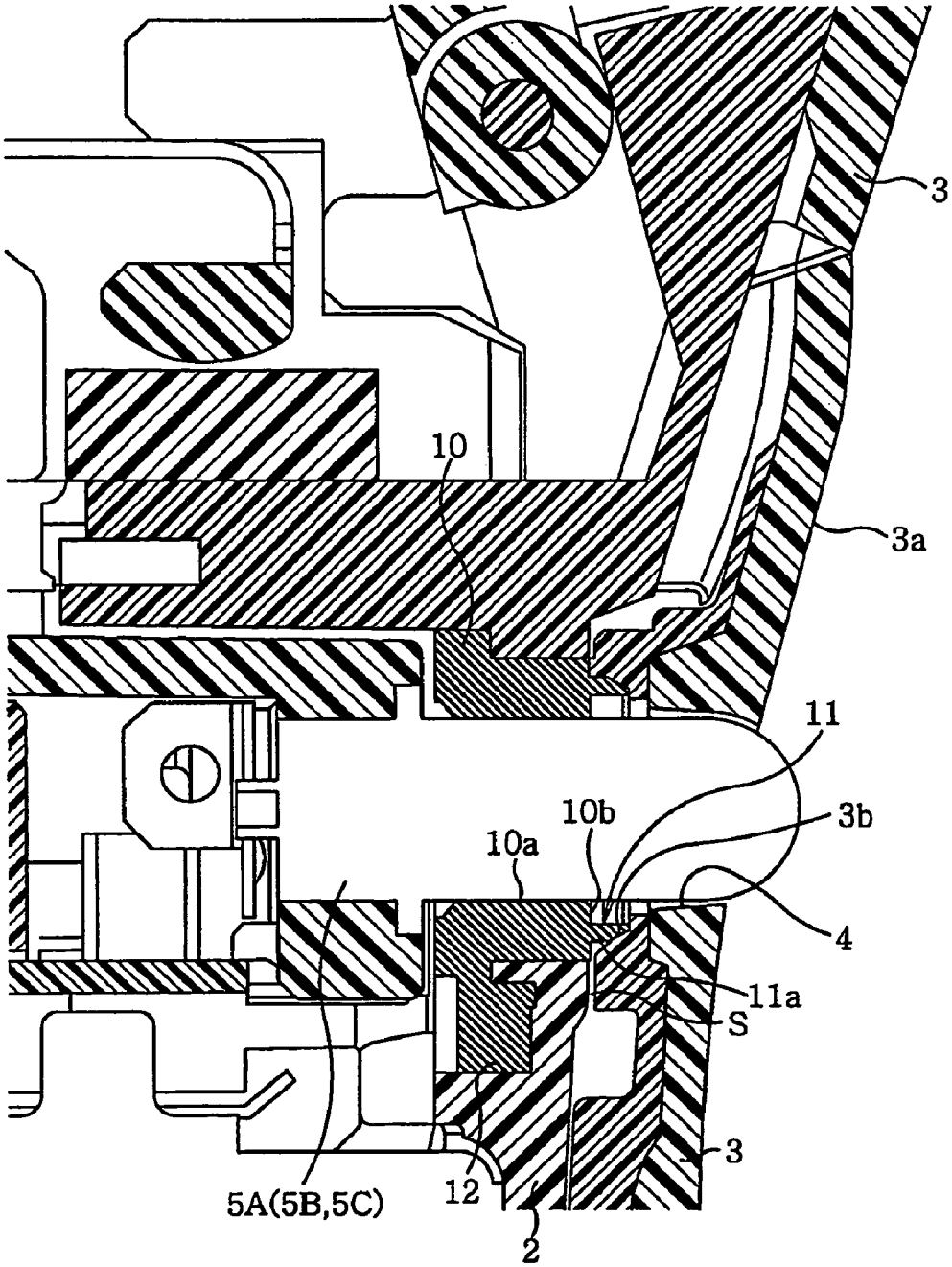
FIG. 4 provides a cross sectional view showing major parts around a charging terminal pin of an electric shaver.
Figure 5A:
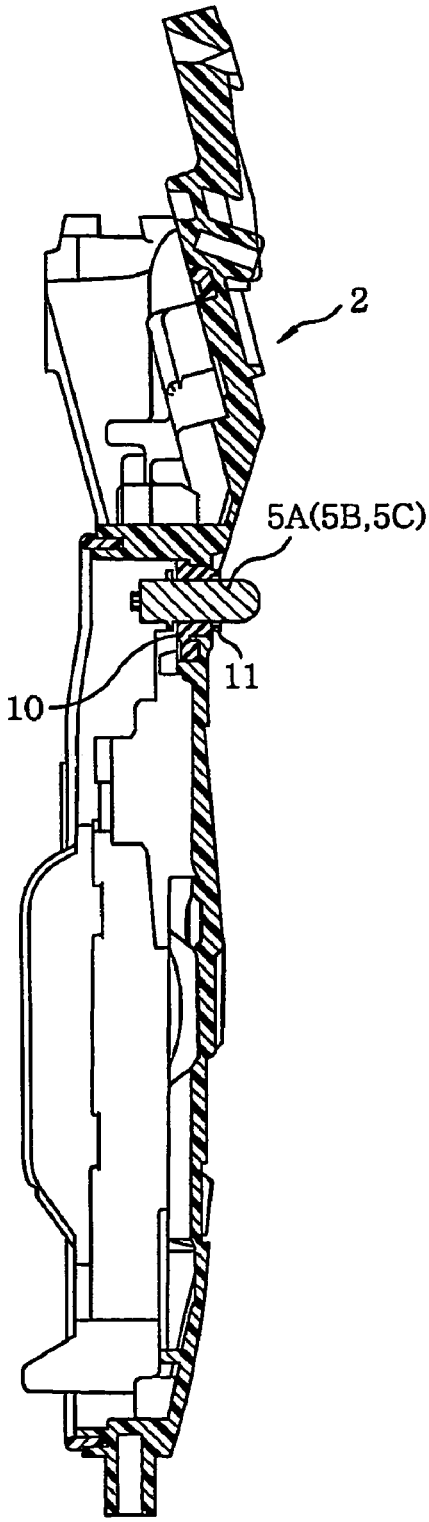
FIG. 5A is a cross sectional view showing major parts around the charging terminal pin and FIG. 5B offers a cross sectional view of a cover member attached to the electric shaver.
Figure 5B:
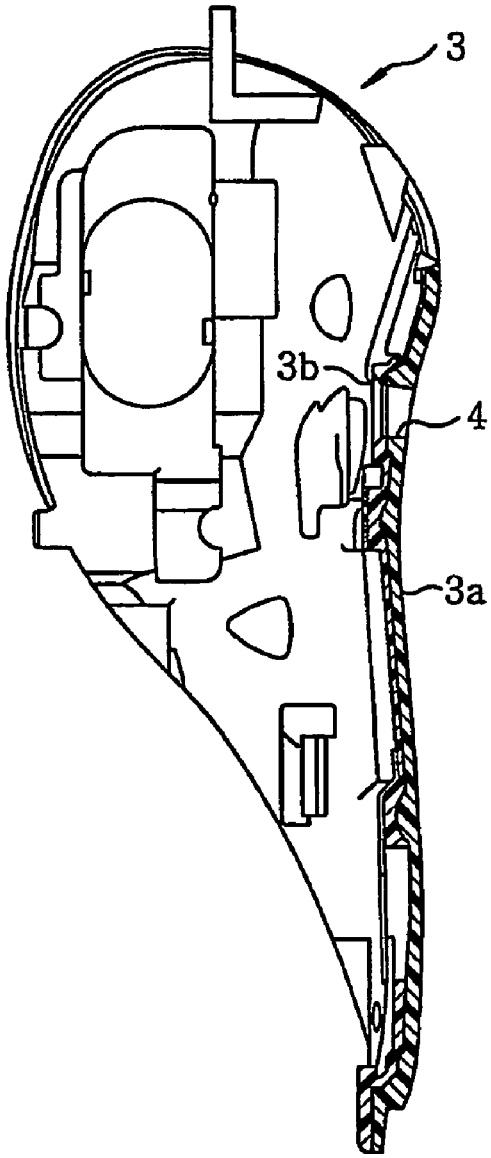

As illustrated in FIGS. 4 to 5B, the charging terminal pins 5A to 5C are disposed through the communication holes 4, and tips of the charging terminal pins 5A to 5C are protruded from a surface 3*a* of the cover member 3. Here, since the three charging terminal pins 5A to 5C have the same configuration, a watertight structure provided at the periphery portion of only one of them, i.e., the charging terminal pin 5A, will be explained.

The watertight structure at the periphery portion of the charging terminal pin 5A is implemented by a sealing member 10 sealing a gap between the housing 2 and the charging terminal pin 5A; and a contact prevention member 11 for preventing water, which has infiltrated into a gap S between the housing 2 and the cover member 3, from contacting the water collected in the communication hole 4 of the charging terminal pin 5A.

The sealing member 10 is formed of an elastic member made of, e.g., rubber, and substantially having a ring shape when viewed from the top thereof, and serves to surround the periphery of the charging terminal pin 5A. A sealing surface 10*a*, which is an inner surface of the sealing member 10, is in firm contact with an outer peripheral surface of the charging terminal pin 5A. The sealing member 10 can be inserted into an attachment groove 12 provided at the housing 2 or can be formed with the housing 2 by dual injection molding. Alternatively, the sealing member 10 can be formed by insert molding when the housing 2 is molded.

The contact prevention member 11 is a protrusion projected toward the cover member 3 from a surface 10*b* of the sealing member 10 which faces the cover member 3, the protrusion having a substantially ring shape when viewed from the top thereof. A leading end 11A of the contact prevention member 11 is in firm contact with an inner peripheral surface of the communication hole 4 of the cover member 3. Like the sealing member 10, the contact prevention member 11 is also formed of an elastic member made of, e.g., rubber as one body with the sealing member 10.

That is, the sealing member 10 is formed as one body with the contact prevention member 11 which functions to prevent the water infiltrated into the gap S between the housing 2 and the cover member 3 from contacting the water collected in the communication hole 4 of the charging terminal pin 5A. Therefore, the watertight structure can be achieved in a simplified manner without increasing the number of components.

As for the electric shaver 1 having the watertight structure as described above, its cutter block 8 is washed by the washing and charging device 6. Though water infiltrates into the gap S between the housing 2 and the cover member 3 while the cutter block 8 is being washed, the contact prevention member 11 prevents such water flows into the communication hole 4 of the charging terminal pin 5A where water is collected. Accordingly, in this electric shaver 1, a short circuit between the charging terminal pins 5A to 5C can be prevented, whereby electrolytic corrosion of the charging terminals pins 5A to 5C can be avoided.

Moreover, since the short circuit between the charging terminal pins 5A to 5C and their electrolytic corrosion can be prevented, it is possible to add decorative features in the vicinity of the charging terminal pins 5A to 5C by the cover member 3, so that a value-added product can be obtained.

Figure 6A:
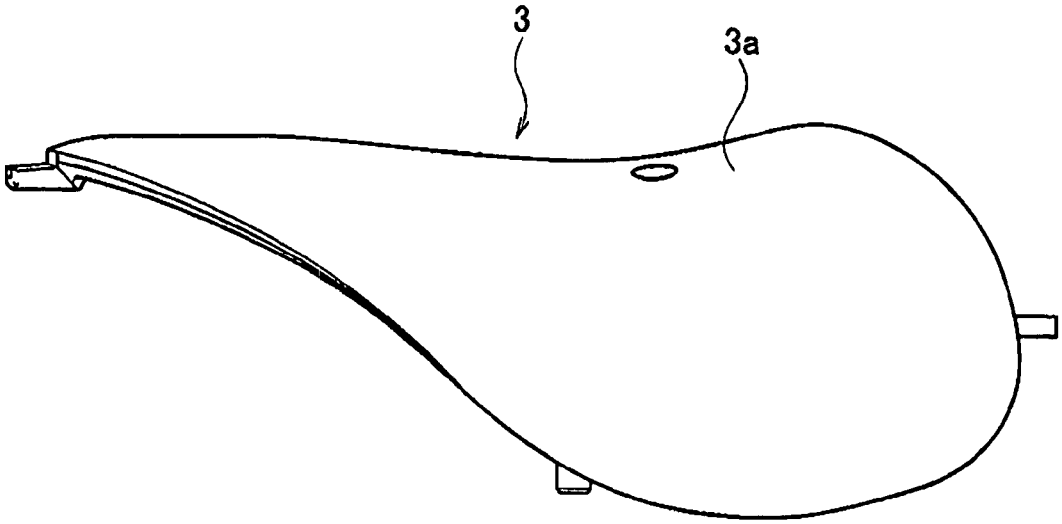
FIGS. 6A and 6B depict a perspective view and a plan view of the cover member, respectively.
Figure 6B:
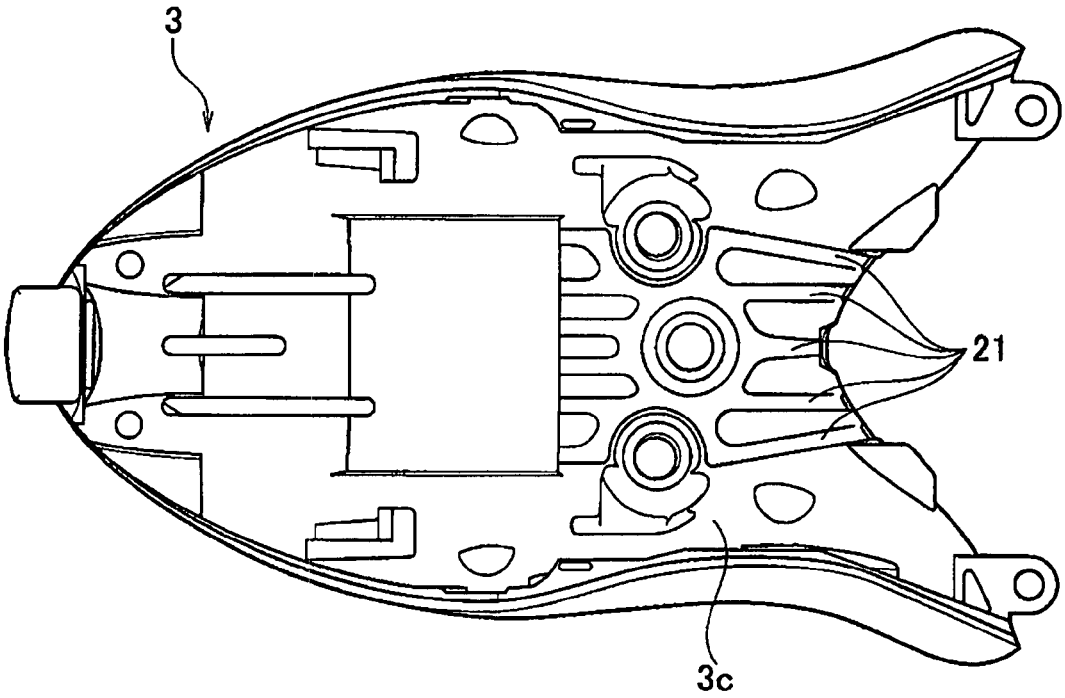

Further, as shown in FIG. 6A and FIG. 6B, a plurality of water drain grooves 21 are provided at an inner surface 3*c* of the cover member 3 of the electric shaver 1 to drain the water infiltrated into the gap S between the housing 2 and the cover member 3. By providing the water drain grooves 21, the water that would otherwise possibly infiltrate into the region around the charging terminal pins 5A to 5C can be drained from the gap S efficiently.

Second Embodiment

Figure 7:
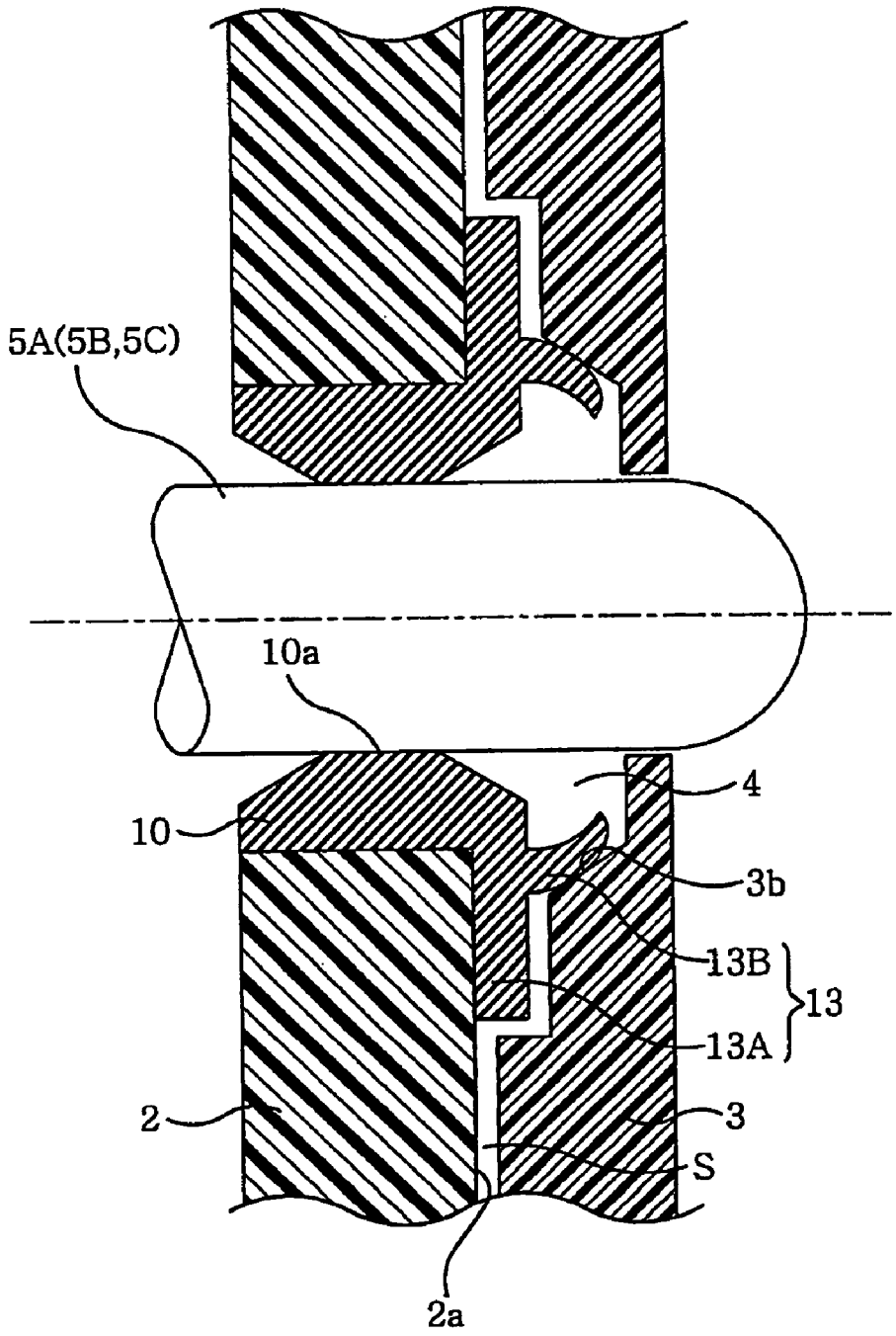
FIG. 7 is a cross sectional view showing major parts of another exemplary watertight structure for a charging terminal pin of an electric shaver.

FIG. 7 is a cross sectional view showing major parts of an exemplary watertight structure for charging terminal pins of an electric shaver in accordance with a second embodiment of the present invention.

In FIG. 7, a contact prevention member 13 includes a first contact prevention part 13A which is in firm contact with the housing 2 and a second contact prevention 13B which is in firm contact with the cover member 3. The contact prevention member 13 is formed as one body with the sealing member 10 sealing the gap between the housing 2 and a charging terminal pin 5A (5B, 5C).

The first contact prevention part 13A is in firm contact with a surface 2*a* of the housing 2 near the communication hole 4. Meanwhile, the second contact prevention part 13B is formed as a protrusion projected from the first contact prevention part 13A toward the cover member 3 and having a substantially annular ring shape when viewed from the top thereof, wherein the leading end of the second contact prevention part 13B is in firm contact with an inner peripheral surface 3*b* of the cover member 3 exposed to the communication hole 4.

Further, the component formed as one body by the sealing member 10 and the contact prevention member 13 can be attached to the housing 2 or can be formed with the housing 2 by dual injection molding. Alternatively, the component can be formed by insert molding when the housing 2 is molded.

The watertight structure shown in FIG. 7 has advantages in that it can prevent a short circuit between the charging terminal pins 5A to 5C and their electrolytic corrosion, as in the first embodiment. Besides, the watertight structure can be achieved in a simplified manner without increasing the number of components.

Third Embodiment

Figure 8:
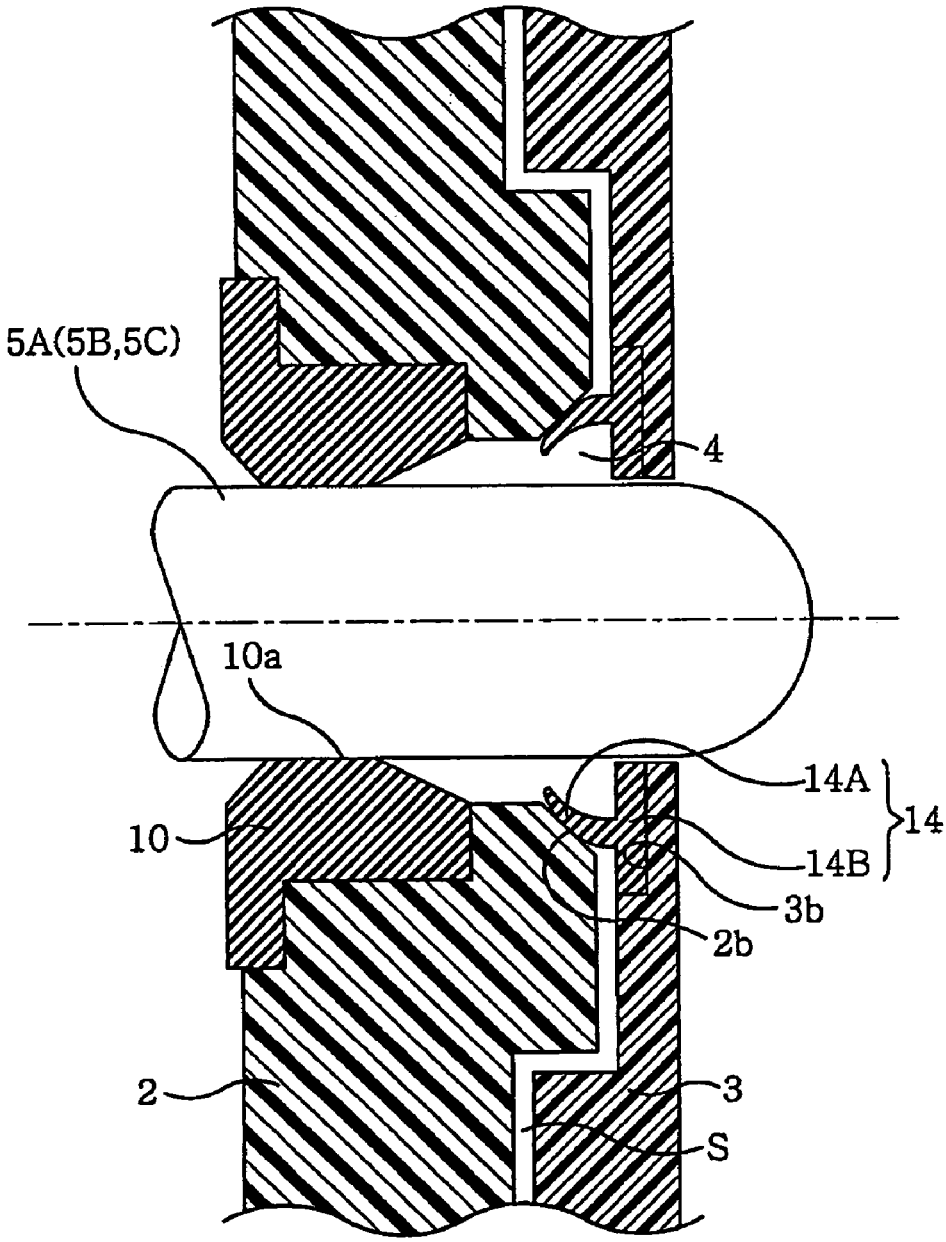
FIG. 8 presents a cross sectional view showing major parts of still another exemplary watertight structure for a charging terminal pin of an electric shaver.

Referring to FIG. 8, there is provided a cross sectional view showing major parts of an exemplary watertight structure for charging terminal pins of an electric shaver in accordance with a third embodiment of the present invention.

In FIG. 8, a contact prevention member 14 includes a first contact prevention part 14A which is in firm contact with the housing 2 and a second contact prevention member 14B which is in firm contact with the cover member 3. Such contact prevention member 14 is formed as one body with the cover member 3, separately of the sealing member 10 for sealing the gap between the housing 2 and the charging terminal pin 5A (5B, 5C).

The first contact prevention part 14A is formed as a protrusion projected from the cover member 3 toward the housing 2 and having a substantially annular ring shape when viewed from the top thereof, wherein the leading end of the first contact prevention member 14A is in firm contact with an end surface 2*b* of the housing 2 near a communication hole 4. Meanwhile, the second contact prevention part 14B is configured to be in firm contact with an inner peripheral surface of the opening of the cover member 3 in the vicinity of the communication hole 4.

Further, the contact prevention member 14 can be attached to the cover member 3 or can be formed with the cover member 3 by dual injection molding. Alternatively, the contact prevention member 14 can be formed by insert molding when the cover member 3 is molded.

The watertight structure illustrated in FIG. 8 has advantages in that it uses the conventional sealing member 10 without having to modify it, while achieving the same effect of preventing a short circuit between the charging terminal pins 5A to 5C and their electrolytic corrosion as attained in the aforementioned embodiments.

Fourth Embodiment

Figure 9:
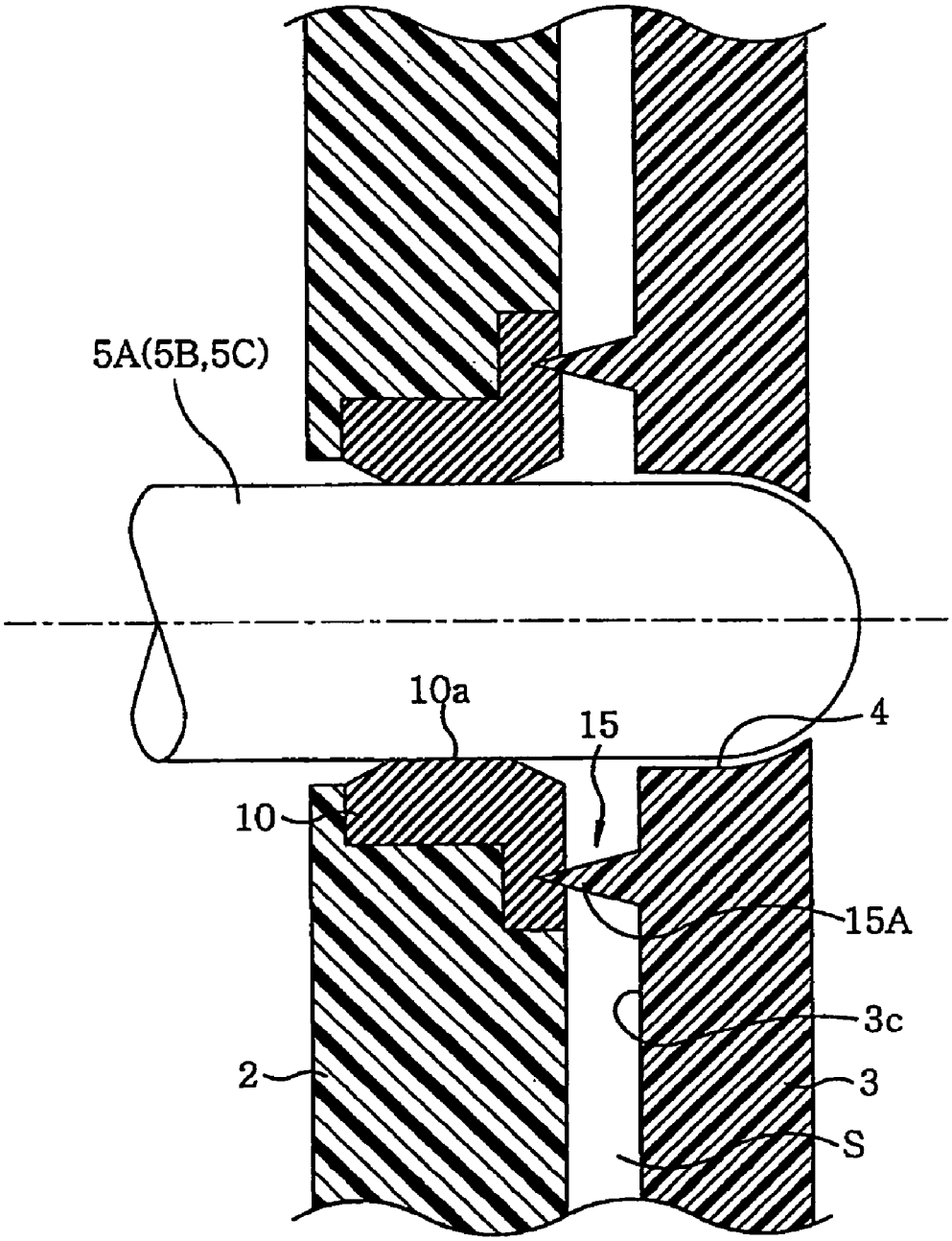
FIG. 9 depicts a cross sectional view showing major parts of still another exemplary watertight structure for a charging terminal pin of an electric shaver.

FIG. 9 is a cross sectional view showing major parts of an exemplary watertight structure for charging terminal pins of an electric shaver in accordance with a fourth embodiment of the present invention.

In FIG. 9, a contact prevention member 15 is formed as a protrusion whose leading end 15A is in firm contact with the sealing member 10 for sealing the gap between the housing 2 and the charging terminal pin 5A (5B, 5C), the protrusion being formed as one body with the cover member 3.

Specifically, the contact prevention member 15 is a protrusion projected from an inner surface 3*c* of the cover member 3 toward the sealing member 10 and having a substantially annular ring shape when viewed from the top thereof. The leading end 15A of the contact prevention member 15 is in firm contact with the sealing member 10. The contact prevention member 15 is formed to have a substantially triangular cross section which is narrowed toward its leading end 15A, and the leading end 15A thereof is lodged in the sealing member 10 to be kept in firm contact with it.

The contact prevention member 15 can be formed as one body with the cover member 3 when the cover member 3 is molded or can be formed with the cover member 3 by dual injection molding while using a material different from that of the cover member 3. Alternatively, the contact prevention member 15 can be formed by insert molding when the cover member 3 is molded.

The watertight structure shown in FIG. 9 has advantages in that the contact prevention member 15 need not be prepared as an independent component, while achieving the same effect of preventing a short circuit between the charging terminal pins 5A to 5C and their electrolytic corrosion as attained in the aforementioned embodiments.

Fifth Embodiment

Figure 10:
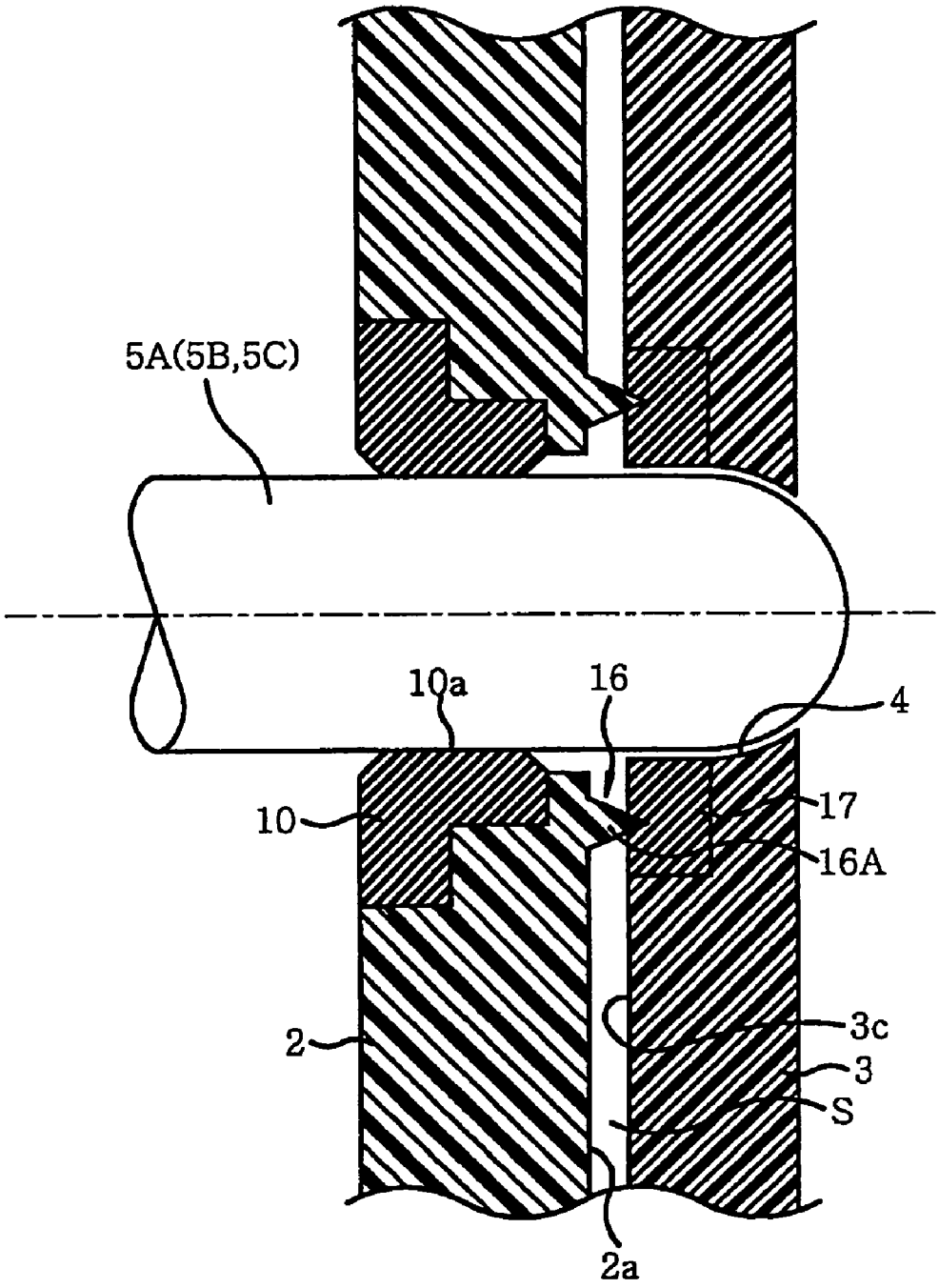
FIG. 10 sets forth a cross sectional view showing major parts of a still another exemplary watertight structure for a charging terminal pin of an electric shaver.

FIG. 10 is a cross sectional view showing major parts of a watertight structure for charging terminal pins of an electric shaver in accordance with a fifth embodiment of the present invention.

In FIG. 10, the contact prevention member 16 is formed as a protrusion whose leading end 16A is in firm contact with the cover member 3. The contact prevention member 16 is formed as one body with the housing 2.

The contact prevention member 16 is formed as a protrusion projected from a surface 2*a* of the housing 2 toward the cover member 3 and having a substantially annular ring shape when viewed from the top thereof, wherein a leading end 16A of the contact prevention member 16 is kept in firm contact with the cover member 3. Further, an elastic member 17, e.g., rubber is provided at a portion of the cover member 3 which faces the leading end 16A of the contact prevention member 16, and the contact prevention member 16 is in firm contact with the elastic member 17. Such contact prevention member 16 has a substantially triangular cross section which is narrowed toward its leading end 16A, and the leading end 16A is lodged in the elastic member 17 to be in firm contact therewith.

Furthermore, the contact prevention member 16 can be formed as one body with the housing 2 when the housing 2 is molded or can be formed with the housing 2 by dual injection molding by using a material different from that of the housing 2. Alternatively, the contact prevention member 16 can be formed by insert molding when the housing 2 is molded.

The watertight structure shown in FIG. 10 has advantages in that the contact prevention member 16 need not be prepared as a separate component, and the elastic member 17 and the leading end 16A can be kept in firmer contact with each other, resulting in an improvement of a sealing performance, while achieving the same effect of preventing a short circuit between the charging terminal pins 5A to 5C and their electrolytic corrosion as attained in the aforementioned embodiments.

Sixth Embodiment

Figure 11:
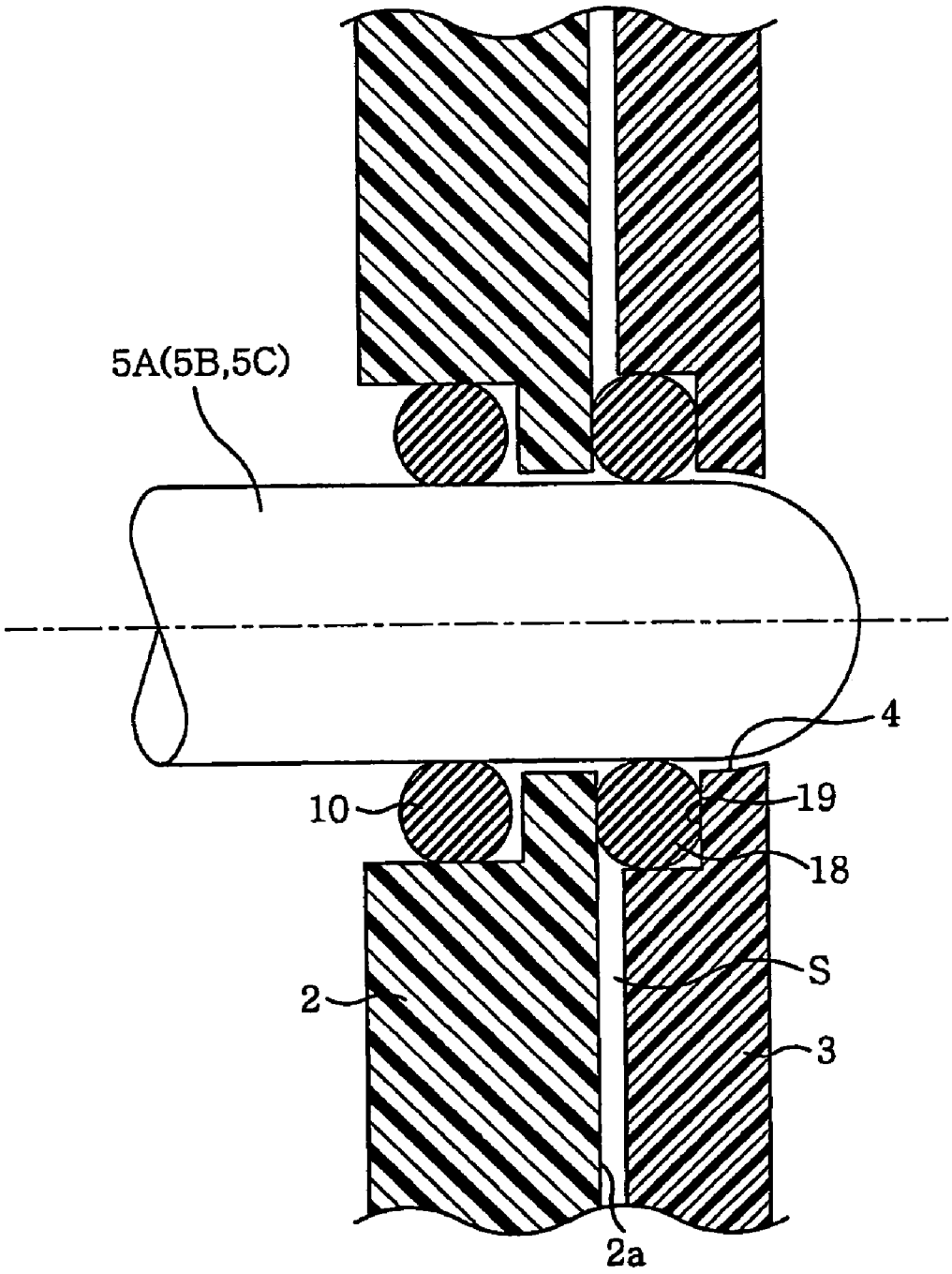
FIG. 11 illustrates a cross sectional view showing major parts of a still another exemplary watertight structure for a charging terminal pin of an electric shaver.

In FIG. 11, a contact prevention member 18 is implemented by an O-ring that is in firm contact with the housing 2 and the cover member 3.

The contact prevention member 18 is disposed in a stepped portion 19 of the cover member 3 in a manner that it is firmly contacted to a surface 2*a* of the housing 2. By providing the contact prevention member 18, a water that infiltrates into the gap S between the housing 2 and the cover member 3 can be prevented from contacting a water collected in a communication hole 4 of a charging terminal pin 5A (5B, 5C).

Further, in this embodiment, an O-ring is also employed as a sealing member 10 to seal the gap between the housing 2 and the charging terminal pin 5A (5B, 5C).

The watertight structure shown in FIG. 11 has advantages in that it enables a cost reduction by using the O-ring that is available on the market, while achieving the same effect of preventing a short circuit between the charging terminal pins 5A to 5C and their electrolytic corrosion as attained in the aforementioned embodiments.

Though the above embodiments have been described for the washing and charging device, the present invention can also applied to a charging device or a washing device.

While the invention has been shown and described with respect to the embodiments, it will be understood by those skilled in the art that various changes and modifications may be made without departing from the scope of the invention as defined in the following claims.

What is claimed is:

1. An insulating structure between conductive members of an electric device, the electric device including a housing accommodating electric components therein and a cover member covering the housing, the conductive members being disposed through communication holes of the housing and the cover member, the insulating structure comprising:

contact prevention members for preventing water infiltrated into a gap between the housing and the cover member from contacting water collected in the communication holes for the conductive members, wherein the contact prevention members are interposed between the housing and the cover member, and each contact prevention member has a substantially annular shape, surrounding one of the conductive members; and a sealing member sealing the gap between the housing and the conductive member.

2. The insulating structure of claim 1, wherein each contact prevention member includes a first contact prevention part in firm contact with the housing and a second contact prevention member in firm contact with the cover member, and each contact prevention member is formed as one body with a sealing member sealing a gap between the housing and the conductive member.

3. The insulating structure of claim 1, wherein each contact prevention member includes a first contact prevention part in firm contact with the housing and a second contact prevention part in firm contact with the cover member, and the contact prevention member is formed as one body with the cover member, separately from a sealing member sealing a gap between the housing and the conductive member.

4. The insulating structure of claim 1, wherein each contact prevention member is a protrusion whose leading end is in firm contact with a sealing member sealing a gap between the housing and the conductive member, the protrusion being formed as one body with the cover member.

5. The insulating structure of claim 1, wherein each contact prevention member is a protrusion whose leading end is in firm contact with the cover member, the protrusion being formed as one body with the housing, and an elastic member is provided at a portion of the cover member in firm contact with each contact prevention member.

6. The insulating structure of claim 1, wherein each contact prevention member is an O-ring which is in firm contact with the housing and the cover member.

7. The insulating structure of claim 2, wherein each contact prevention member formed as one body with the sealing member is formed with the housing by dual injection molding.

8. The insulating structure of claim 3, wherein each contact prevention member formed as one body with the cover member is formed with the cover member by dual injection molding.

9. The insulating structure of claim 1, wherein water drain grooves for draining the water infiltrated into the gap between the housing and the cover member are provided at an inner surface of the cover member.

10. The insulating structure of claim 1, wherein the electric device is an electric shaver, and the electric shaver is charged via the conductive members when the electric shaver is mounted in a charging device.

11. The insulating structure of claim 1, wherein the cover member serves as a decorative panel.

12. The insulating structure of claim 1, wherein the conductive members include tips being protruded from a surface of the cover member.

13. The insulating structure of claim 1, wherein the sealing member is inserted into an attachment groove provided at the housing.

* * * * *